United States Patent [19]

Farden

[11] 4,286,383

[45] Sep. 1, 1981

[54] APPARATUS WITH MOTOR-DRIVEN PEELING DEVICE

[76] Inventor: Arne S. B. Fardén, Harjagersgatan 7, 245 00 Staffanstorp, Sweden

[21] Appl. No.: 899,812

[22] Filed: Apr. 25, 1978

[30] Foreign Application Priority Data

Apr. 25, 1977 [SE] Sweden ..... 7704725

[51] Int. Cl.[3] ..... A47L 11/12

[52] U.S. Cl. ..... 30/169; 30/272 R; 299/37; 15/93 R

[58] Field of Search ..... 30/169, 170, 172, 272; 15/93; 299/37

[56] References Cited

U.S. PATENT DOCUMENTS

| | | | |
|---|---|---|---|
| 2,137,842 | 11/1938 | Jackson | 299/37 X |
| 2,155,713 | 4/1939 | Jargick | 299/37 X |
| 2,589,138 | 3/1952 | Reno | 30/272 R |
| 2,722,072 | 11/1955 | Aspeek | 30/272 R |
| 2,874,946 | 2/1959 | Singleterry et al. | 299/37 |
| 4,053,958 | 10/1977 | Taylor | 299/37 |
| 4,162,809 | 7/1979 | Anderson et al. | 299/37 |

FOREIGN PATENT DOCUMENTS

| | | | |
|---|---|---|---|
| 1177046 | 8/1964 | Fed. Rep. of Germany | 30/169 |

*Primary Examiner*—W. D. Bray

*Attorney, Agent, or Firm*—LeBlanc, Nolan, Shur & Nies

[57] ABSTRACT

A portable apparatus for peeling off mats and the like glued on floors, etc., or of wallpaper and the like pasted on walls. The apparatus comprises a motor-driven machine with oscillating drive means to which a cutting tool blade (knife edge or saw edge) is connected and, during the operation of the machine, performs an oscillating movement in the plane of the tool, which tool performs a cutting or sawing movement substantially reciprocatory in the longitudinal direction of the cutting edge.

5 Claims, 10 Drawing Figures

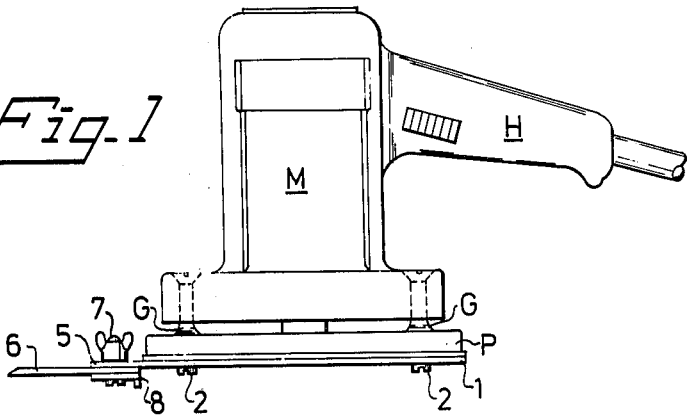
Fig. 1
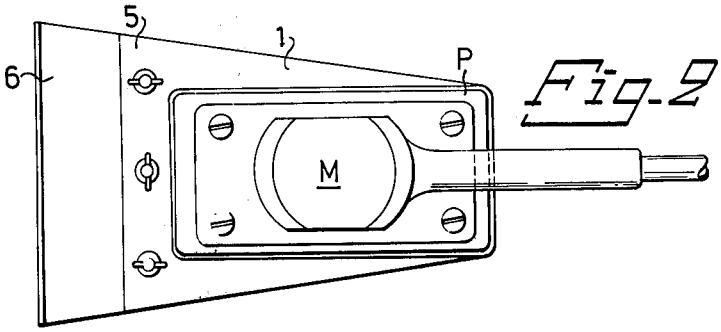
Fig. 2
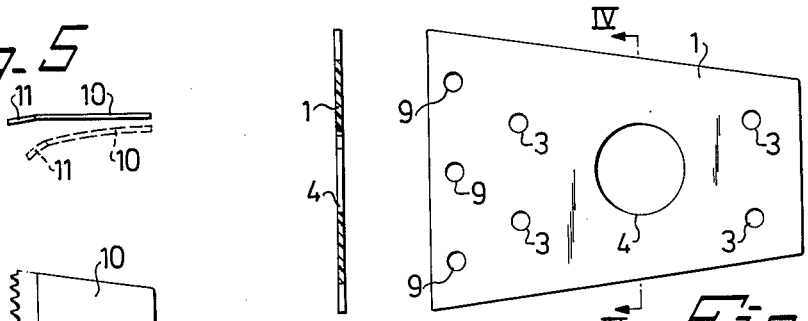
Fig. 3
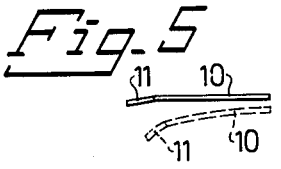
Fig. 5
Fig. 4
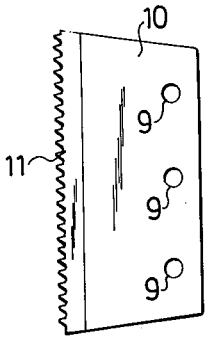
Fig. 6
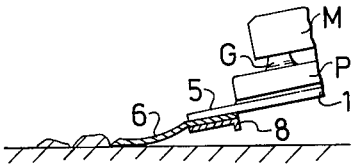
Fig. 7

26
27
25
H
M
23
G
7
5
6
8
2
1
P
24

APPARATUS WITH MOTOR-DRIVEN PEELING DEVICE

BACKGROUND OF THE INVENTION

This invention relates to an apparatus comprising a machine-driven peeling device with oscillating movement preferably for leveling or peeling elevations occurring on floors, walls or other surfaces, which elevations on floors may consist of remainders from removed mats and the like and on walls may consist of remainders from removed wallpaper and the like. The apparatus according to the invention, however, can also be used for other purposes.

Floor-layers usually use for the aforesaid purpose a hand scraper or shovel, which render the work troublesome and tedious. It also is known on very large floor areas to be cleaned from old and worn floorings to utilize an electrically operated machine with a cutting tool blade, which is reciprocated in a shoveling movement transverse to the blade direction. The tool blade for having the desired effect often must carry out its shoveling movement obliquely downward, which involves the risk of damaging the floor surface when this consists of a less hard material as, for example, masonite. The shoveling cutting edge, besides, has a relatively short length, 10–12 cm, so that the cutting capacity is not as high as desired.

The present invention has the object of providing an apparatus with a machine-driven peeling device, which is labour-saving by high cutting capacity and easiness of handling.

This object is achieved by an apparatus comprising a peeling device, which is provided with a plate-shaped cutting tool blade having a cutting or sawing edge for peeling off and preferably away remainders of mats and the like glued on floors etc. or of wallpapers and the like pasted on walls, and mounted on a portable motor-driven machine. Said apparatus according to the invention is characterized in that the motor-driven machine is provided with an oscillating drive means known per se, for example, a basic eccentric drive mechanism as shown in U.S. Pat. No. 2,874,946 to V. A. Singleterry et al, with which the peeling device is rigidly connected, and during operation of the machine performs an oscillating or to some extent circulating movement in the plane of the cutting or sawing tool blade, so that the cutting edge of the cutting or sawing tool blade carries out a cutting or sawing movement substantially reciprocally in the longitudinal direction of the cutting edge.

The invention is illustrated by some embodiments shown by way of example in the accompanying drawings.

FIG. 1 is a side view of an apparatus according to the invention with a peeling device mounted on a machine driven by an electric motor.

FIG. 2 is a view from above on the apparatus according to FIG. 1.

FIG. 3 is a horizontal view of a detail comprised in the peeling device.

FIG. 4 is a section along the line IV—IV in FIG. 3.

FIGS. 5 and 6 are an end view and, respectively, horizontal view of a sawing blade for the peeling device.

FIG. 7 shows in a schematic manner a portion of the machine and peeling device, the latter by way of a section, and in operation.

Figure 8:
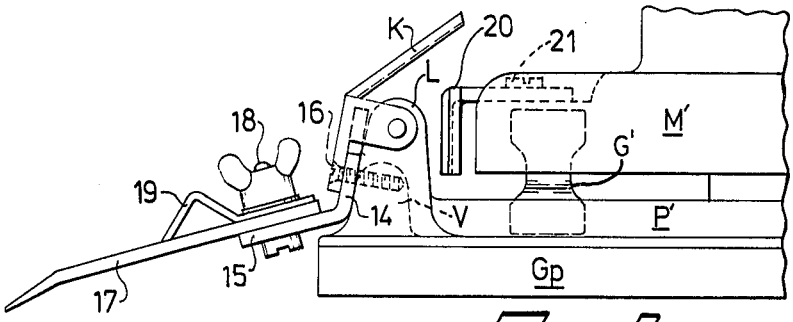
FIG. 8 is a side view of a peeling device according to the invention with a modified design and mounted on an electrically driven machine shown only partially.

The peeling device according to the invention shown in FIGS. 1–7 comprises a holder in the form of a stiff or rigid plate 1, preferably of, for example, 4 mm thick textile bakelite, nylon, reinforced glass fibre, light metal such as aluminium etc. and is intended by glueing and by screws 2 extending through holes 3 to be attached to a drive plate P, which via rubber dampers G is supported by drive mechanism M driven by an electric motor. Said drive mechanism includes an oscillatory drive means (known per se) and a handle H. Said plate 1 includes a central hole 4, FIGS. 3,4, permitting an adjusting tool access to the mechanism M. The plate 1 has a free portion 5, which projects outside the surface of the plate P remote relative to the handle H, and against the lower surface of which a cutting tool blade 6 is detachably retained by means of screws 7 with wing nuts and of a clamping and stiffening bar 8, preferably of aluminium and with angular cross-section. The screws 7 extend through holes 9 shown in FIGS. 3 and 6.

The cutting tool blade 6 according to FIGS. 1 and 2 has a thickness of 0.5 mm, has a certain elasticity, is entirely plane and is provided with a straight cutting edge being beveled with an angle of approximately 3°–6° only on the upper surface.

FIGS. 5 and 6 illustrate the peeling blade, the dotted line of FIG. 5 illustrating the side view of an alternative blade configuration. The peeling blade, as shown in solid lines, has two parts, a flat plate 10 and a saw blade 11, e.g., a hacksaw blade, rigidly connected as by welding along the front edge of the flat plate 10. Examples of suitable welding are spot welding and braze welding. As an alternative configuration the plate 10 can be slightly curved downwardly as shown in the dotted line side view of FIG. 5. The plane of the saw blade 11 is inclined downward about 5°–8° relative to the upper surface of the blade plate 10, i.e. the teeth of the saw blade 11 are located slightly below the lower surface of the blade plate 11.

When using the afore-described device for peeling off from a floor the remainders of glued or rubber-coated old mats, such as cork mats or wall-to-wall carpets, which have been removed, the device is held so, that the portion 5 of the plate 1 holding the cutting tool blade 6 is directed obliquely downward, as shown in FIG. 7, but the inclination may vary. The cutting edge of the cutting tool blade 6 is moved against the elevation on the floor, whereby the bearing of the cutting tool blade against the place of contact causes a slight downward bending, seen in cross-section, of about 5 mm, so that the lower surface of the cutting edge of the cutting tool blade 6 lies substantially in parallel with the floor. The mechanism M causes the cutting tool blade 6 to perform an oscillating or vibrating or to some extent circulating movement in the plane of the plate 1, so that the cutting edge carries out a rapid cutting movement of, for example, 4 mm substantially reciprocatory in the longitudinal direction of the cutting edge, which results in that the elevation as well as other irregularities of the floor rapidly are cut through, with little inconvenience for the worker holding the handle H of the device.

When the irregularities of the floor consist of remainders from fluffy carpet underlays or other material containing textile threads or the like, preferably the tool blade 10 with the saw blade 11 according to FIGS. 5,6 is utilized, whereby the rapid oscillatory movement of the saw blade rapidly saws through the material.

When other surfaces, for example walls are to be cleaned from wallpaper remainders, glue, paint and the like, the cutting tool blade 6 should preferably be used.

The most important advantages of the peeling device according to the invention are that the device can be mounted on the oscillation-generating drive means of any portable motor-driven machine and thereby forms a tool, which is easy to handle and labour-saving, and by which the peeling can be carried out 50% more rapidly than in the case of usual manual peeling. Due to the fact that the cutting edge portion of the cutting tool blade 6 owing to the curvature of the blade lies in parallel with the floor, there is no risk of damaging the floor. The cutting or sawing member can easily be exchanged when desired. The entire peeling device consists of parts easy to manufacture at relatively low cost.

Figure 9:
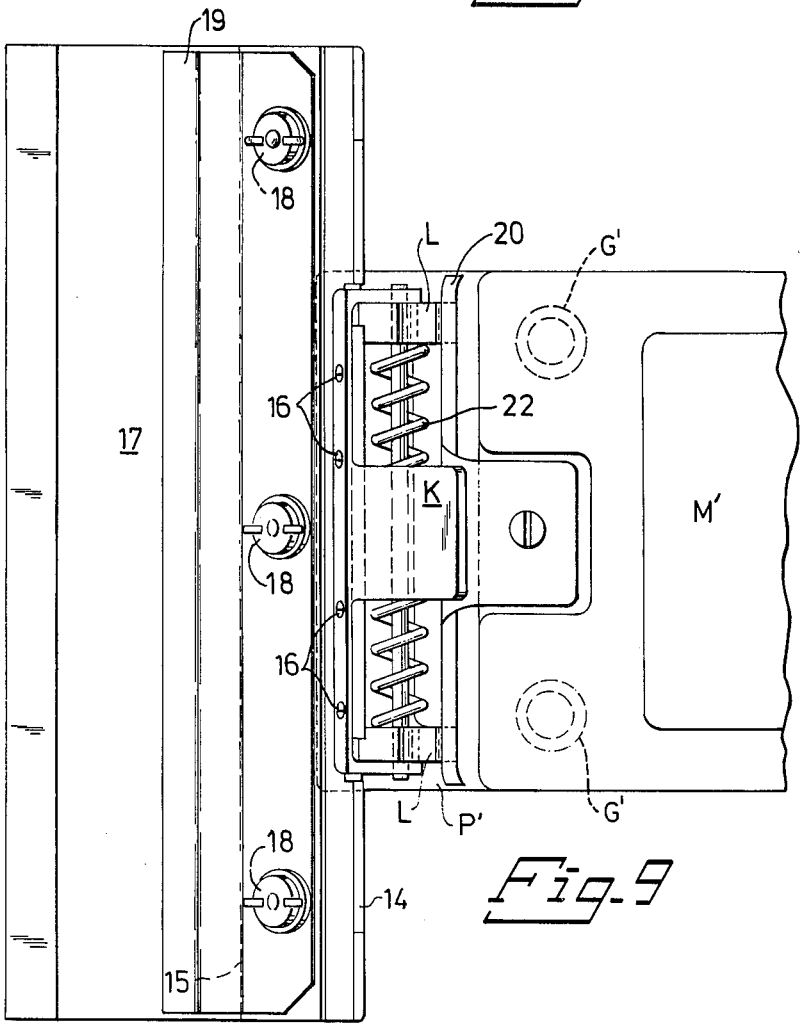
FIG. 9 is a view from above of the apparatus according to FIG. 8.

According to the embodiment shown in FIGS. 8 and 9, a mechanism M' driven by an electric motor and only partially shown is provided with an oscillatory foot-plate P' having a rubber plate Gp on its lower surface. At one side of the foot-plate P' a clamp K is supported in bearing blocks L, between which a bead V extends. All these details are known.

According to the invention, the peeling device comprises a holder consisting of a base portion 14, which by means of screws 16 is attached between a portion of the clamp K and the bead V, into which the screws 16 are screwed, and a freely projecting portion 15, by which a cutting tool blade 17 is retained detachably by means of screws 18 with wing nuts. The base portion 14 and the free portion 15 relative to each other form a V and preferably an angle of 120° between said two portions 14,15, which are of same length. The base portion 15 is slightly inclined with the plane of the foot-plate P'.

On the cutting tool blade 17 a guard strip 19 is attached detachably by means of the screws 18 with wing nuts. The forward side of the strip forms an angle of about 135° with the blade 17. Said guard strip is attached to the cutting tool blade 17 only when it is desired that the material peeled off from cork or plastic floors or walls is led off from the machine. Particularly in the peeling of wallpaper the guard strip works well to provide a coiling of peeled-off material.

On the portion of the mechanism M' which is directed to the cutting tool blade 17, an abutment angle 20 is attached detachably by screws 21, which angle 20 is intended, by contact with the bearing blocks L or a spring 22 normally provided on the machine between said blocks, to prevent the foot-plate P' from oscillating movement too far to the rear relative to the drive mechanism M' during working operations, which excessive movement would be detrimental to the strength of the rubber dampers G'. The abutment angle, thus, acts as a torque buffer.

The particular advantages of the embodiment according to FIGS. 8,9 are that at a standard grinding machine only the detail connected to the clamp K is to be removed, and holes for the screws 16 are to be drilled and threaded in the bead V, whereafter the peeling device easily can be mounted and after use be dismounted from the grinding machine, which thereafter easily can be prepared for its normal use.

Figure 10:
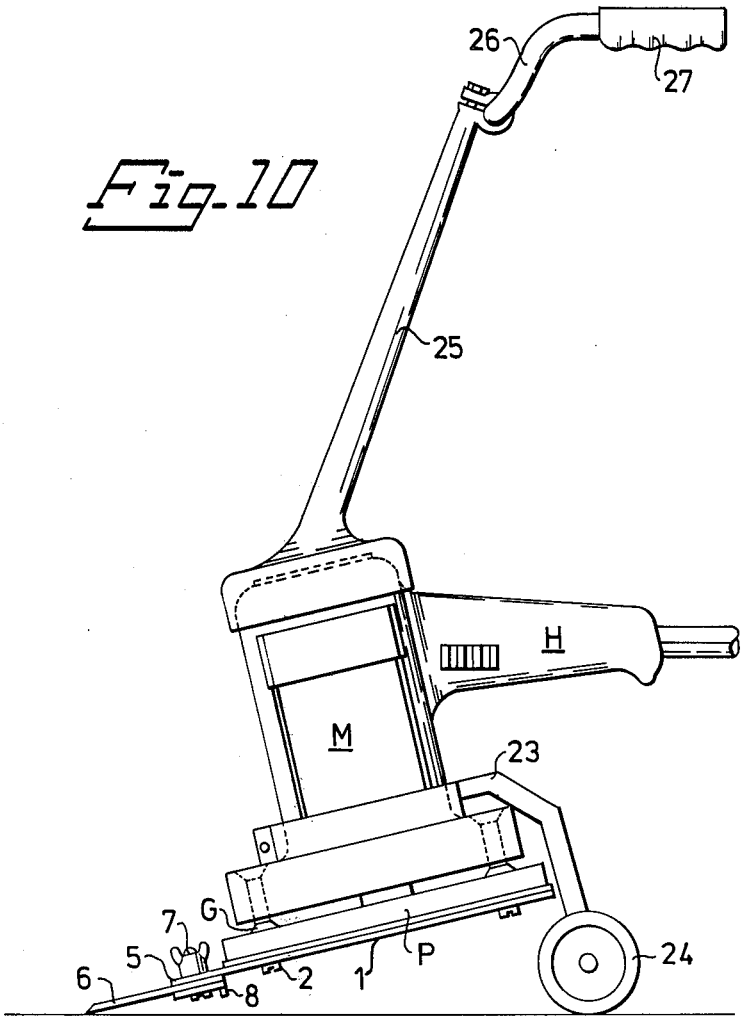
FIG. 10 is a side view of an apparatus with a peeling device in a modified embodiment.

The machines shown in FIGS. 1,2,7–9 are intended to be held in one hand and possibly be supported by the other hand against the top of the machine when in operation. FIG. 10, however, shows a movable machine 14, about which a detachable holder 23 with two drive wheels 24 is clamped, of which wheels only one is visible in FIG. 10. The distance of the wheels 24 to the machine can be adjustable for changing the inclination angle of the machine. To the uppermost portion of the machine 14 a guide rod 25 with a handle bar 26 having two handles 27 (only one visible) is detachably attached. This embodiment renders it possible for the worker to carry out flooring work in standing position and handily balance the pressure of the cutting tool blade against the floor. The worker preferably walks slightly forwardly inclined and loads the machine by the weight of his body, so that no possible additional weights on the machine are required. The holder 23 with the drive wheels 24 as well as the guide rod 25 with handle bar 26 can after demand easily be mounted on and dismounted from the machine.

The invention must not be regarded restricted to the embodiments described and shown in the drawings, but can be varied within the scope of the invention idea. The peeling device, for example, may be supported by an air-operated or hydraulic machine, a magnetic vibrator or a motor vibrator. The cutting edge may be wave-shaped in the longitudinal direction or have an inclined longitudinal direction in relation to the advancing direction. The cutting edge shape can be varied. The blade 10 combined with the saw blade may be of a rigid material other than steel. The members for retaining the cutting or saw blade on the rigid plate can be varied, in which case the clamping and stiffening bar 8 can be omitted, particularly when the cutting or saw blade has a thicker base portion. The outer outline of the disc 1 can be varied. The base portion 14 for attaching the peeling device to a machine may have varying design, and it may be sufficient that the screws 16 in the bead V extend only through the base portion when the apparatus according to the invention is used as a gardening tool for leveling purposes.

I claim:

1. A portable peeling apparatus comprising: a portable motor-driven unit and a peeling device with a plate-shaped cutting tool blade having opposed upper and lower sides and a cutting edge for peeling off remainders of materials on flat surfaces, such as floors, walls and the like, mounted on the motor-driven unit, said motor-driven unit being provided with an oscillatory drive means including an oscillating plate to which said peeling device with said blade is rigidly connected so that said peeling device, during operation of the unit, performs an oscillatory movement in the plane of the cutting blade so that the cutting edge of the cutting blade undergoes a circulatory cutting movement which is substantially reciprocatory in the longitudinal direction of the cutting edge; said oscillatory drive means including at its forward upper portion, an integral lateral bead; said peeling device including a holder having a base portion and a forwardly extended portion; means detachably securing said cutting tool blade to said forwardly extended portion, and means detachably securing said base portion of the holder to said lateral bead.

2. An apparatus as defined in claim 1, wherein a guard deflector strip is detachably secured on said upper side of said cutting tool blade.

3. An apparatus as defined in claim 1 wherein rubber dampers means mount said motor unit to said drive means which supports said cutting tool blade and wherein an abutment angle is fastened on a portion of the motor unit closely adjacent the cutting tool blade for limiting movement of said drive means and hence limiting torsional stresses in the rubber damper means due to movement of the blade.

4. A portable peeling apparatus comprising: a portable motor-driven unit and a peeling device with a plate-shaped cutting tool blade having a cutting edge for peeling off remainders of materials on flat surfaces, such as floors, walls and the like, mounted on the motor-driven unit, said motor-driven unit being provided with an oscillatory drive means to which said peeling device with said blade is rigidly connected so that said peeling device, during operation of the unit, performs an oscillatory movement in the plane of the cutting blade so that the cutting edge of the cutting blade undergoes a circulatory cutting movement which is substantially reciprocatory in the longitudinal direction of the cutting edge; rubber dampers mounting said motor unit to said oscillatory drive means which supports said cutting tool blade; an abutment angle being fastened on a portion of the motor unit closely adjacent the cutting tool blade for limiting movement of said oscillatory drive means and hence limiting torsional stresses in the rubber dampers due to movement of the blade.

5. A portable peeling apparatus comprising: a portable motor-driven unit and peeling device with a plate-shaped cutting tool blade having opposed upper and lower sides and a cutting edge for peeling off remainders of materials on flat surfaces, such as floors, walls and the like, mounted on the motor-driven unit, said motor-driven unit being provided with an oscillatory drive means including a motor with a rotary drive shaft, an oscillatory rigid plate portion, flexible rubber damper means fastening said rigid plate portion to said motor, said rotary shaft being eccentrically connected to said rigid plate portion, means detachably, rigidly securing the cutting tool blade to said oscillatory rigid plate portion whereby during operation of the unit, said rigid plate portion and said blade perform an oscillatory movement in the plane of the cutting blade so that the cutting edge of the cutting blade undergoes a circulating cutting movement at least part of which is substantially reciprocatory in the longitudinal direction of the cutting edge, and an abutment angle fastened on a portion of the motor unit closely adjacent the cutting tool blade for limiting movement of said drive means and hence limiting torsional stresses in the rubber damper means due to movement of the blade.

* * * * *